United States Patent [19]

Gross et al.

[11] Patent Number: 4,726,375

[45] Date of Patent: Feb. 23, 1988

[54] DEPILATORY DEVICE FOR REMOVING HAIR

[75] Inventors: Joseph Gross, Moshav Mazor; David Lowenstein, Natanya; Menahem Tilman, Hofit; Etan Rosenberg, Kiryat Ono, all of Israel

[73] Assignee: General Ideas and Products Ltd., Tel Aviv, Israel

[21] Appl. No.: 31,760

[22] Filed: Mar. 30, 1987

[30] Foreign Application Priority Data

Mar. 4, 1987 [IL] Israel ..... 81779

[51] Int. Cl.[4] ..... A61B 17/00

[52] U.S. Cl. ..... 128/355

[58] Field of Search ..... 128/303 R, 355, 749, 128/751, 755; 17/47

[56] References Cited

U.S. PATENT DOCUMENTS

| | | | |
|---|---|---|---|
| 1,232,617 | 7/1917 | Shipp | 128/355 |
| 1,743,590 | 1/1930 | Binz | 128/355 |
| 2,900,661 | 8/1959 | Schnell | 128/355 |
| 4,079,741 | 3/1978 | Daar et al. | 128/355 |
| 4,279,253 | 7/1981 | Haes et al. | 128/355 |
| 4,524,772 | 6/1985 | Daar et al. | 128/355 |

*Primary Examiner*—Max Hindenburg

*Attorney, Agent, or Firm*—Benjamin J. Barish

[57] ABSTRACT

A depilatory device for removing body hair, comprises a manually-grippable housing, and a hair-plucker body rotatably mounted to the housing and having an exposed section formed with a plurality of gaps in its outer surface which open and close during the rotation of the hair-plucker body to receive, pluck, and eject body hair growing on a surface over which the hair-plucker body is moved. The hair-plucker body is a flexible cylindrical member of plastic on elastomeric material having a smooth outer surface formed with a plurality of slits penetrating only partially through the cylindrical member and extending circumferentially thereof. The cylindrical member is rotated about its longitudinal axis and is supported in an arcuate position such that the slits open at the convex side of the cylindrical member during its rotation to receive the hairs between the open confronting faces of the slits, and close at the concave side of the cylindrical member during its rotation to clamp the hairs between the closed confronting faces of the slits.

19 Claims, 8 Drawing Figures

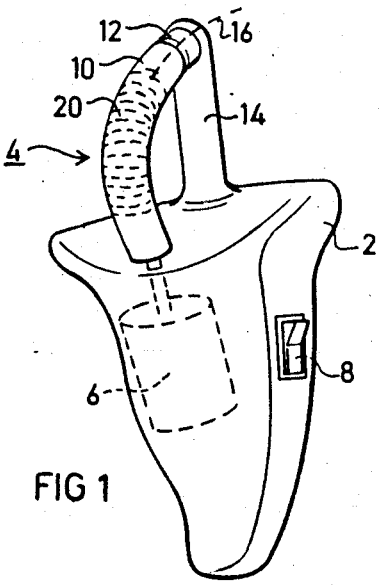
FIG 1
FIG 2
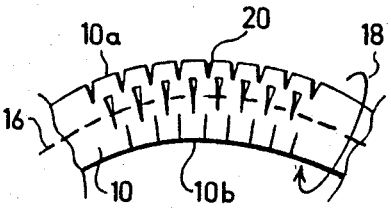
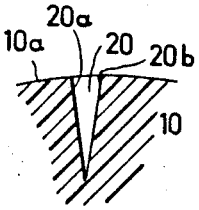
FIG 2a
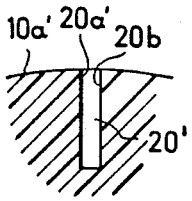
FIG 2b
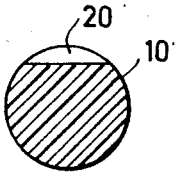
FIG 3
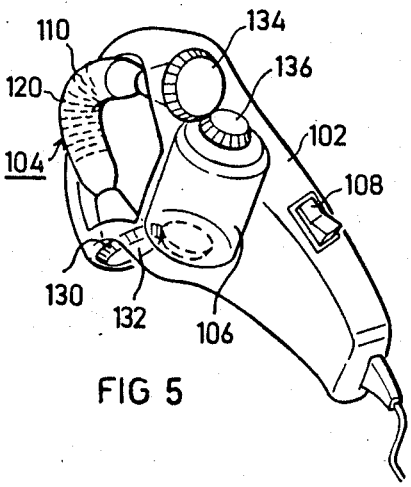
FIG 5
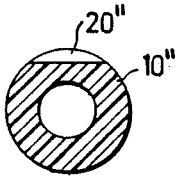
FIG 4a
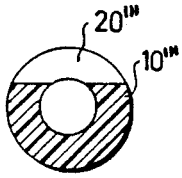
FIG 4b

DEPILATORY DEVICE FOR REMOVING HAIR

BACKGROUND OF THE INVENTION

The present invention relates to depilatory devices for removing body hair, such as are used for cosmetic purposes.

A number of depilatory devices for this purpose have been proposed in the past. Some devices include discs arranged to provide gaps of wedge-like configurations for catching and plucking the hair; a device of this type is illustrated by U.S. Pat. No. 2,900,661. Other devices include helical springs which define the hair-catching gaps between their windings; examples of the latter are described in U.S. Pat. Nos. 1,232,617, 4,079,741 and 4,524,772, the first two being axial helical springs, and the latter being an arcuate spring.

An object of the present invention is to provide a depilatory device which uses neither discs nor helical springs but defines the hair-catching gaps in another manner, producing a number of advantages over the prior devices as will be described more particularly below.

BRIEF SUMMARY OF THE INVENTION

According to the present invention, there is provided a depilatory device for removing body hair, comprising a manually-grippable housing, and a hair-plucker body rotatably mounted to the housing and having an exposed section formed with a plurality of gaps in its outer surface which open and close during the rotation of the hair-plucker body to receive, pluck and eject body hair growing on a surface over which the hair-plucker body is moved. The hair-plucker body is a flexible cylindrical member of plastic material having a smooth outer surface formed with a plurality of slits penetrating only partially through the plastic cylindrical member and extending circumferentially thereof. The cylindrical member is rotatable about its longitudinal axis and is supported in an arcuate position such that the slits open at the convex side of the plastic cylindrical member during its rotation to receive the hairs between the open confronting faces of the slits, and close at the concave side of the plastic cylindrical member during its rotation to clamp the hairs between the closed confronting faces of the slits.

There is thus an important difference in the construction of the depilatory device of the present invention, wherein the hair-plucker body is in the form of a plastic cylindrical member and the gaps are in the form of slits, over the prior known devices wherein the hair-plucker body is in the form of a helical spring and the gaps are produced by spacing the coil windings of the spring. This basic constructional difference provides a number of important advantages.

One very important advantage is that the plastic cylindrical member provides a softer feel to the skin than the helical spring which, as a practical matter, and in the commercial form, is of metal. Further, making the hair-plucking gaps in the form of slits penetrating only partially through the plastic cylindrical member, produces less possibility of "pinching" the skin than in the helical spring arrangement wherein the gaps are defined by the coil windings which move towards and away from each other. Further, the slits in the novel construction provide a much larger surface area for contacting and clamping the hairs, thereby making the device more effective to remove the shorter hairs. Further, the plastic cylindrical member applied against the skin rather, than a metal helical spring, reduces the danger of electrical shock when the device is electrically operated, and thereby obviates the need and expense for stepping-down the line voltage if the device is to be connected to the line. A still further advantage is that the plastic cylindrical member may be manufactured in volume and at low cost, for example by extrusion, and therefore significantly reduces the overall cost of the device.

Each of the slits formed in the outer surface of the plastic cylindrical member preferably extends for less than the complete circumference of the member; a preferred range is from one-fourth to one-half its circumference. This has been found to substantially reduce the possibility of plucked hairs becoming wedged in the slits and not being ejected when the slits open at the convex side of the plastic cylindrical member.

The plastic cylindrical member may be of solid construction, or may be of a hollow construction. Various flexible plastic materials are available for this purpose, for example nylon resins, acetal resins, polycarbonates, polyethylene and polypropylene. The term "plastic" is also intended to include elastomeric materials, such as natural or synthetic rubber, polyurethane, etc.

The slits preferably have flat planar surfaces which are either of V-shaped configuration or of rectangular configuration when on the convex surface of the plastic cylindrical member. The rectangular configuration produces a lower tendency of the hairs becoming wedged within the slits so as not to be ejected when the slits reopen, but this possibility is substantially eliminated by extending the slits only partially around the circumference of the plastic cylindrical member as mentioned above.

Two electrically-driven embodiments of the invention are described below for purposes of example. In one described embodiment, the partially-slitted member is coupled at one end to the motor, its opposite end being received in a rotatable bearing mounted on a stem projecting axially of the housing. In a second described embodiment, the two opposite ends of the partially-slitted plastic cylindrical member are coupled to the electric motor.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a three-dimensional view illustrating one form of depilatory device constructed in accordance with the present invention;

FIG. 2 is an enlarged fragmentary view illustrating the construction of the partially-slitted plastic cylindrical member and the slits therein which are opened and closed during its rotation to receive, pluck and eject body hair growing on a surface over which the partially-slitted member is moved;

FIG. 2*a* and 2*b* are enlarged fragmentary views illustrating two possible constructions of the slits in the partially-slitted member of FIG. 2.

FIG. 3 is a sectional view along lines III—III of the FIG. 2;

FIGS. 4*a* and 4*b* are sectional views similar to that of FIG. 3 but illustrating a modification in the construction of the partially-slitted member; and FIG. 5 illustrates a second embodiment of the invention.

DESCRIPTION OF PREFERRED EMBODIMENTS

The depilatory device illustrated in FIG. 1 comprises a manually-grippable housing 2, and a hair-plucker body, generally designated 4, rotatably mounted to the housing and rotated by an electric motor 6. This motor is disposed within housing 2 and is energized and de-energized by an electrical switch 8. The rotatable hair-plucker body 4 is in the form of a plastic cylindrical member 10 having one end received within housing 2 and coupled to the electric motor 6. The opposite end of the plastic cylindrical member 10 is received within a bearing 12 mounted at the end of a stem 14 projecting axially of housing 2. The arrangment is such that the plastic cylindrical member 10 is supported in the form of a small arc, e.g. of about 90° or less, and is rotated about its longitudinal axis as indicated by arrow 18 when motor 6 is energized.

Plastic cylindrical member 10 is of a flexible plastic material and may be of a solid construction as illustrated in FIG. 3. It includes a smooth outer face formed with a plurality of discrete slits 20 extending only partially through member 10. Each slit 20 extends circumferentially of member 10 but for a length less than its complete circumference, preferably for less than one-half its complete circumference.

FIG. 2 is an enlarged fractional view illustrating the slits 20 formed in the outer surface of the plastic cylindrical member 10 when the tube is supported in the arcuate manner illustrated in FIG. 1, and is rotated around its longitudinal axis as illustrated by dotted line 16. Thus, when the plastic cylindrical member is in its arcuate shape, its outer convex surface 10*a* is tensioned, and therefore the slits 20 there are opened or widened. On the other hand, the inner concave surface 10*b* of the plastic cylindrical member 10 is under compression, and therefore the slits 20 there are closed. Accordingly, as the plastic cylindrical member 10 rotates about its longitudinal axis 16 by motor 6, the slits 20 will open at the convex surface 10*a* of member 10, and will close at its concave surface 10*b*.

Each of the slits 20 may be, when occupying the convex surface 10*a* of the slitted member 10, either of V-shape configuration as shown in FIG. 2*a* or of rectangular configuration as shown in FIG. 2*b*. In either such configurations, each slit is formed with flat planar confronting faces, as shown at 20*a*, 20*b* in FIG. 2*a*, or at 20*a*', 20*b*' in FIG. 2*b*. Both such arrangements provide extensive surfaces, when the slits are open, for engagement with the hairs, thereby better assuring plucking-out the hairs particularly the short hairs close to the skin, as compared for example with the known helical-spring arrangement wherein point-contact with the hairs is made by the windings of the spring, rather than extensive-surface contact by the planar-face construction of the slits in the present invention.

Both the V-shaped configuration of slits 20 and the rectangular-shaped configuration of slits 20', illustrated in FIGS. 2*a* and 2*b*, respectively, whichever is used, are preferably initially made on the outer convex surface 10*a* of the plastic member as the member is supported in its arcuate position. The rectangular configuration slits shown in FIG. 2*b* tend to reduce the possibility of wedging of the hairs within the slits after they have opened, and thereby better assure their ejection; however, as pointed out earlier, ejection of the hairs is also better assured by forming each slit for less than the circumference of the cylindrical member 10, preferably for less than one-half its circumference.

The device illustrated in FIGS. 1-3 is used in the following manner:

The user grips the housing 2, energizes the electric motor 6 by operating switch 8, and moves the arcuate, plastic, cylindrical member 10 across the skin containing the body hair to be removed. The device is held at an oblique angle to the skin so that the skin contact is made with the surface of the plastic cylindrical member 10 slightly after its convex surface 10*a*, in the direction of rotation of the member. Thus, member 10 contacts the skin while the slits 20, having reached their fully open positions, are just starting to close. The body hair thus enters these open slits 20, and during the rotation of the plastic cylindrical member, the slits close, pluck out the hair, and then open to eject the hair.

The plastic cylindrical member 10 solid may also be of a hollow construction, in which case the slits 20 could be for a depth less than the thickness of the hollow tube as shown at 20'' and 10'' in FIG. 4*a*, or greater than the thickness of the hollow tube as shown at 20''' and 10''' in FIG. 4*b*.

As described earlier, the plastic construction as described above provides a "softer" feel, and less possibility to "pinch" than the helical spring construction when the device is moved across the user's skin to remove the body hair. In addition, making it of plastic reduces the possibility of electrical shock and eliminates the need for a step-down transformer in order to energize motor 6 from the supply mains.

FIG. 5 illustrates another embodiment of the invention, also including a manually-grippable housing 102 and a hair-plucker body 104 mounted to the housing and rotated by electric motor 106 within the housing under the control of an electric switch 108. The hair-plucker body 104 in the FIG. 5 embodiment is also in the form of a plastic cylindrical member 110, solid or hollow, and formed with a plurality of circumferentially-extending slits 120 as in the arrangement described above with respects to FIGS. 1-4. In the embodiment of FIG. 5, however, the plastic cylindrical member 120 is supported in an arc of about 180°, and both of its opposite ends are rotated by motor 106. Thus, one end of member 110 is coupled to a gear 130 meshing with another gear 132 at one end of electric motor 106, and the opposite end of member 110 is coupled to another gear 134 meshing with a further gear 136 at the opposite end of the electric motor.

The structure, operation, and advantages of the device illustrated in FIG. 5 are otherwise the same as described above with respect to FIGS. 1-4.

While the invention has been described with respect to several preferred embodiments, it will be appreciated that many variations and modifications of the invention may be made. For example, while best results are obtained when the hair-plucker body (10, 110) is of perfect cylindrical configuration, good results are also obtainable when it is merely of generally cylindrical configuration, such as slightly elliptical or polygonal. Other variations, modifications and applications of the invention will be apparent.

What is claimed is:

1. A depilatory device for removing body hair, comprising: a manually-grippable housing, and a hair-plucker body rotatably mounted to the housing and having an exposed section formed with a plurality of gaps in its outer surface which open and close during the rotation of the hair-plucker body to receive, pluck, and eject body hair growing on a surface over which the hair-plucker body is moved; characterized in that said hair-plucker body is a flexible cylindrical member of plastic material having a smooth outer surface formed with a plurality of slits penetrating only partially through the plastic cylindrical member and extending circumferentially thereof, said plastic cylindrical member being rotated about its longitudinal axis and being supported in an arcuate position such that said slits open at the convex side of the plastic cylindrical member during its rotation to receive the hairs between the open confronting faces of the slits, and close at the concave side of the plastic cylindrical member during its rotation to clamp the hairs between the closed confronting faces of the slits.

2. The device according to claim 1, wherein each of said slits extends for less than one-half the complete circumference of said plastic cylindrical member.

3. The device according to claim 1, wherein said slits have flat planar surfaces of V-shaped configuration when in their open condition on the convex side of the plastic cylindrical member.

4. The device according to claim 1, wherein said slits have flat planar surfaces of rectangular configuration when in their open condition on the convex sides of the plastic cylindrical member.

5. The device according to claim 1, wherein said plastic cylindrical member is of solid construction.

6. The device according to claim 1, wherein said plastic cylindrical member is of hollow construction.

7. The device according to claim 1, further including an electric motor within said housing for rotating said plastic cylindrical member, and an electrical switch carried by said housing for energizing and de-energizing said motor.

8. The device according to claim 7, wherein said plastic cylindrical member is coupled at one end to said motor, its opposite end being received within a rotatable bearing mounted on a stem projecting axially of said housing.

9. The device according to claim 8, wherein said plastic cylindrical member is supported in an arc of up to about 90°.

10. The device according to claim 7, wherein said plastic cylindrical member is supported in an arc of about 180° and its opposite ends are coupled to said electric motor.

11. A depilatory device for removing body hair, comprising: a manually-grippable housing, and a hair-plucker body rotatably mounted to the housing and having an exposed section formed with a plurality of gaps in its outer surface which open and close during the rotation of the hair-plucker body to receive, pluck, and eject body hair growing on a surface over which the hair-plucker body is moved; characterized in that said hair-plucker body is a flexible cylindrical member of plastic material having a smooth outer surface formed with a plurality of slits penetrating only partially through the plastic cylindrical member and extending circumferentially thereof for less than one-half its circumference, said plastic cylindrical member being rotated about its longitudinal axis and being supported in an arcuate position such that said slits open at the convex side of the plastic cylindrical member during its rotation to receive the hairs between the open confronting faces of the slits, and close at the concave side of the plastic cylindrical member during its rotation to clamp the hairs between the closed confronting faces of the slits.

12. The device according to claim 11, wherein said slits have flat planar surfaces of V-shaped configuration when in their open condition on the convex side of the cylindrical member.

13. The device according to claim 11, wherein said slits have flat planar surfaces of rectangular configuration when in their open condition on the convex sides of the cylindrical member.

14. The device according to claim 11, wherein said cylindrical member is of solid construction.

15. The device according to claim 11, wherein said cylindrical member is of hollow construction.

16. The device according to claim 11, further including an electric motor within said housing for rotating said cylindrical member, and an electrical switch carried by said housing for energizing and de-energizing said motor.

17. The device according to claim 16, wherein said cylindrical member is coupled at one end to said motor, its opposite end being received within a rotatable bearing mounted on a stem projecting axially of said housing.

18. The device according to claim 17, wherein said cylindrical member is supported in an arc of up to about 90°.

19. The device according to claim 16, wherein said cylindrical member is supported in an arc of about 180° and its opposite ends are coupled to said electric motor.

* * * * *